US005865367A

United States Patent [19]

Benham

[11] Patent Number: 5,865,367

[45] Date of Patent: Feb. 2, 1999

[54] BOX WITH IMPROVED REMOVABLE STRIP

[75] Inventor: Albert A. Benham, Tuscaloosa, Ala.

[73] Assignee: Gulf States Paper Corporation, Tuscaloosa, Ala.

[21] Appl. No.: 12,642

[22] Filed: Jan. 23, 1998

Related U.S. Application Data

[62] Division of Ser. No. 595,044, Feb. 1, 1996, Pat. No. 5,769, 310.

[51] Int. Cl.[6] ..... B65O 5/54

[52] U.S. Cl. ..... 229/240; 229/207; 229/232; 229/237; 229/924

[58] Field of Search ..... 229/125.35, 133, 229/160.2, 207, 208, 227, 232, 237, 240, 242, 902, 903, 906, 924, 931

[56] References Cited

U.S. PATENT DOCUMENTS

| | | | |
|---|---|---|---|
| 2,608,341 | 8/1952 | Eckman | 229/207 |
| 3,096,918 | 7/1963 | Van Dyke et al. | 229/227 |
| 3,270,946 | 9/1966 | Redpath et al. | 229/207 |
| 3,410,476 | 11/1968 | Buttery . | |
| 3,502,257 | 3/1970 | Virros . | |
| 3,863,834 | 2/1975 | Sandford . | |
| 4,046,313 | 9/1977 | Perry | 229/227 |
| 4,083,454 | 4/1978 | O'Neill . | |
| 4,386,705 | 6/1983 | Meuller | 229/207 |
| 4,449,633 | 5/1984 | Johnson et al. . | |
| 4,531,668 | 7/1985 | Forbes, Jr. | 229/125.35 |
| 4,919,785 | 4/1990 | Willey et al. . | |
| 4,989,735 | 2/1991 | O'Brien . | |
| 5,007,542 | 4/1991 | Roccaforte . | |
| 5,078,273 | 1/1992 | Kuchenbecker . | |
| 5,090,615 | 2/1992 | Murakami et al. . | |
| 5,183,201 | 2/1993 | Gulliver . | |
| 5,217,159 | 6/1993 | Calvert et al. . | |
| 5,330,099 | 7/1994 | Beales et al. | 229/207 |
| 5,402,931 | 4/1995 | Gulliver et al. . | |
| 5,769,310 | 6/1998 | Benham | 229/240 |

*Primary Examiner*—Gary E. Elkins
*Attorney, Agent, or Firm*—Pillsbury Madison & Sutro LLP

[57] ABSTRACT

A box having a container space for retaining box contents is provided. The box is constructed of a foldable sheet material. The box includes first and second side panels, first and second edge panels, and first and second end flaps. All flaps and panels are foldable about associated fold lines to effect a box having sides and seal ends which together define the container space. A removable strip portion is provided on either an end flap or an edge panel to provide access to the container space. The removable strip portion is defined by interior and exterior partial cuts scored into the foldable material, including a plurality of aligned interrupted exterior cuts that are disposed for an extent coincidentally with an associated fold line. The removable strip portion thus constructed helps ensure folding of the associated flap or panel about the intended fold line while maintaining the strength and integrity of the folded edge.

5 Claims, 4 Drawing Sheets

BOX WITH IMPROVED REMOVABLE STRIP

This application is a divisional of Ser. No. 09/595,044, filed Feb. 1, 1996, U.S. Pat. No. 5,769,310 issued Jun. 23, 1998.

BACKGROUND OF THE INVENTION

1. Field of the Invention

This invention relates to a box having a container space suitable for retaining box contents and also having a removable strip portion to permit access to the container space.

2. Description of the Related Art

Conventional openers, usually disposed along narrow flaps on conventional box-type packages, typically involve the provision of zipper type cuts in combination with other features. Many different zipper configurations have been employed. The most common zipper configuration consists of first and second lines of 100% through cuts running parallel to each other along the long dimension of a flap. Each line of cuts consists of a series of spaced angular cuts. Each angular cut consists of two legs spaced apart by an angle which is less than 180° and greater than 90°. Each angular cut is arranged so that one leg of each angular cut is aligned with corresponding legs of the other angular cuts. The remaining legs of the angular cuts extend angularly in a parallel relation or direction toward the other line of angular cuts.

When the flap is narrow and is attached to a panel along a fold line, there may not be room for two lines of zipper cuts, a fold line, and extra paperboard at the outside edge for gluing the flap in place. For this reason, one line of the zipper cuts is often used as a fold line. When a line of zipper cuts is used as a fold line, however, the zipper cuts themselves are weakened and present an unattractive appearance.

When the flap is folded, usually mechanically, it will generally fold at the weakest fold line. Consequently, it is not practical to have a line of zipper cuts in close parallel relation with a fold line because of the tendency of the fold to occur along the adjacent line of zipper cuts rather than the intended fold line. Moreover, even where one line of zipper cuts is used as a fold line, the close proximity of the other line of zipper cuts presents a situation where the fold could be effected on either line of zipper cuts or both unless extra time consuming care is taken in the process.

Zipper cuts also have the effect of limiting the space available for printed matter on a flap. This effect is worsened when a fold is made along a line of zipper cuts.

Conventional zipper type box openers, because they are formed by 100% through cuts, have a number of other disadvantages, including:

1. If a flap is folded about a line of zipper cuts, there is a chance of product contamination through gaps in the fold line;

2. There is a chance of product leaking or wicking through the fold line;

3. There is a chance that board rupture will occur along the fold line; and

4. Upon removal of the zipper from the flap, a messy appearance is presented because of the amount of tearing of the box material that takes place.

Furthermore, because zipper cuts include an opposite line of zipper cuts opposing the line of zipper cuts defining the fold line, other disadvantages result which include:

1. A printing surface that is marred by the cuts defining the zipper; and

2. An additional weak line on the flap which might inadvertently fold in the machine folding process rather than the intended fold line.

In addition, zipper type opening features are usually uni-directional which allows removal in only one direction. Also, because of the shape of the cuts and their depth through the board, the plane of the board is disrupted, permitting the cut edges to be caught and torn during the machine folding process if the machine direction of travel opposes the zipper.

Because a zipper is removed by a tearing process rather than a delamination process, there is a great likelihood of creating small paperboard pieces which could contaminate the product. This same feature also creates a less attractive appearance when the box is opened.

SUMMARY OF THE INVENTION

It is an object of the present invention to avoid the disadvantages expressed above. In accordance with the principles of the present invention, this objective is obtained by providing a box, having six walls and defining a container space, composed of a foldable sheet material having exterior and interior surfaces defining a thickness therebetween, the box comprising: first and second side panels disposed in opposed spaced relation with respect to each other and defining the height and width of the box; first and second edge panels defining the height and depth of the box and disposed in opposed spaced relation with respect to each other, the first edge panel being integral along first edge fold lines with the first and second side panels the second edge panel being integral along a second edge fold line with the second side panel; and first, second, third, and fourth end flaps, the first and second end flaps being integral with opposite ends of the first side panel along first and second end flap fold lines, respectively, and the third and fourth end flaps being integral with opposite ends of the second side panel along third and fourth end flap fold lines, respectively. The box includes two end walls defined by the overlapping first and third end flaps and the overlapping second and fourth end flaps. The box provides a removable strip portion disposed on an access panel. The access panel comprises the top flap of the overlapping first and third end flaps or the top flap of the overlapping second and fourth end flaps. The removable strip portion is constructed and arranged to be removed from the access panel to permit access to the container space and is defined on an exterior surface thereof by exterior score patterns, and on an interior surface thereof by interior score patterns. The removable strip portion is constructed and arranged to be removed by manually grasping a grippable portion thereof and pulling the removable strip portion away from the access panel to progressively delaminate the sheet material between the interior and exterior score patterns along a predetermined removal path including an extent adjacent an associated fold line of the access panel. The interior score pattern includes continuous interior cut lines partially penetrating the thickness from the interior surface and disposed for at least an extent thereof in a closely spaced generally parallel arrangement. The interior score pattern extends along the predetermined removal path to ensure that delamination occurs along the predetermined removal path. The exterior score pattern includes exterior cuts partially penetrating the thickness from the exterior surface and extending along the predetermined removal path to ensure that delamination occurs along the predetermined removal path. The exterior cuts include a plurality of aligned interrupted cuts disposed along at least a portion of the associated fold line of the access panel to ensure that the integrity of the exterior surface at the associated fold line of the access panel is retained and to ensure that the access panel is folded about the associated fold line.

With the fold line made up of a partial depth perforation cut in a channel rather than a zipper cut 100% through the board, several advantages result, including:

1. There is less chance of product contamination through gaps in the fold line;

2. There is less chance of product leaking or wicking through the fold line;

3. There is less chance that board rupture will occur along the fold line; and

4. Less tearing takes place which presents a neater appearance.

Because there is no opposite zipper cut opposing the fold line's zipper cut, other advantages result which include:

1. A clean printing surface not marred by the zipper cuts; and

2. No weak line which might fold in the machine folding process rather than the intended fold line.

Moreover, the removable strip portions of the box of the present invention can be designed to run in a direction convenient to the consumer. Because the opener is not uni-directional, a grippable portion could be placed on both ends of the removable strip portion, accommodating both left and right handed consumers.

Advantages are also shown when the box is sealed closed. Because the outermost partial cut line of the opener is on the outside surface of the paperboard, it is not affected by the adhesive or sealing on the backside surface. This can permit a larger target area for glue or a narrower flap.

Because the opening of the box is caused by a delamination process rather than a tearing process, there is less likelihood of creating small paperboard pieces which could contaminate the product. This same feature also creates a more attractive appearance when the box is opened.

Other objects, features, and characteristics of the present invention will become more apparent upon consideration of the following description and in the appended claims with reference to the accompanying drawings, all of which form a part of this specification, wherein like reference numerals designate corresponding parts in the various figures.

DETAILED DESCRIPTION OF THE PRESENTLY PREFERRED EXEMPLARY EMBODIMENTS

Figure 1:
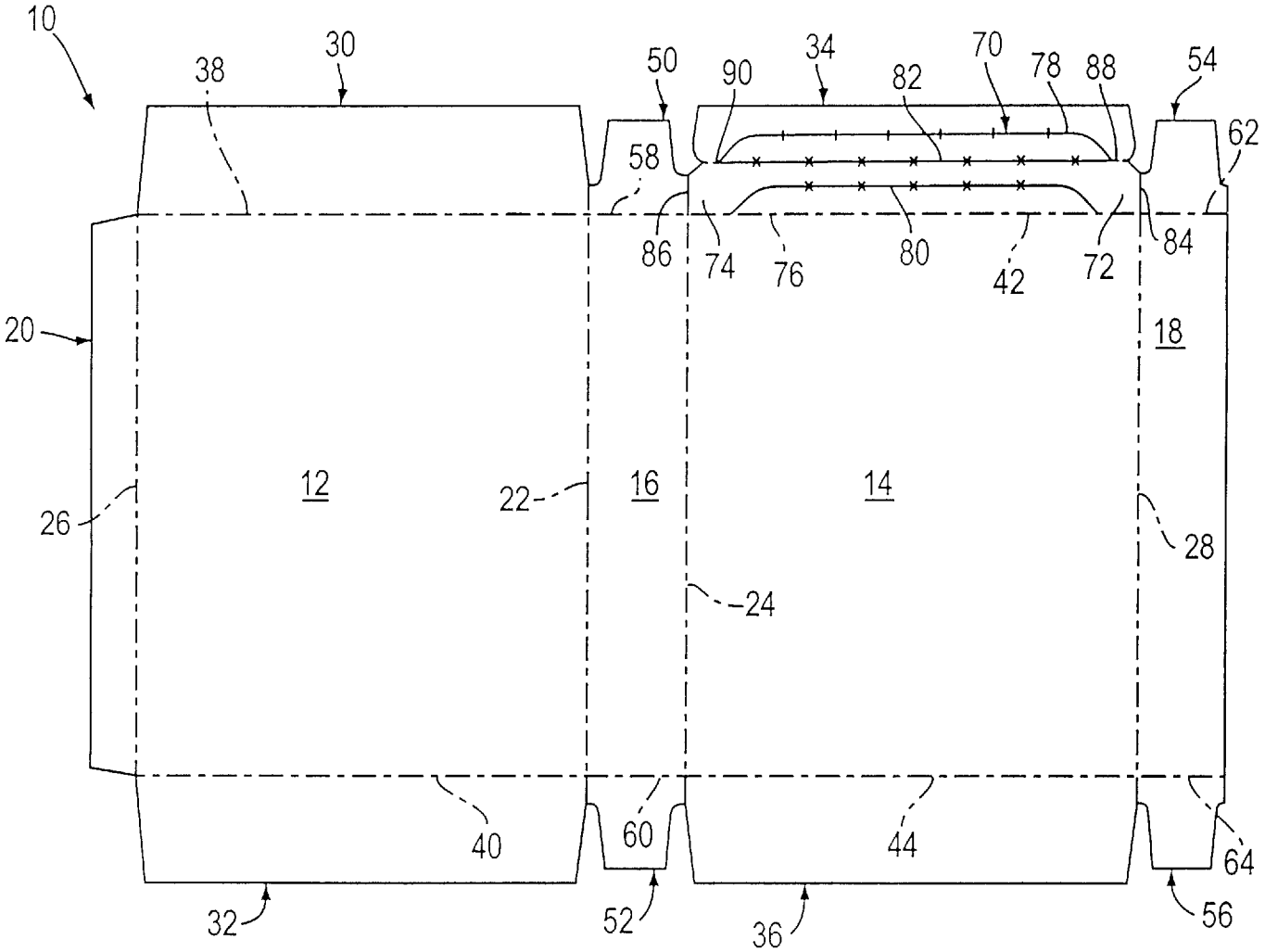
FIG. 1 is a plan view of a blank cut and scored so as to be erectable into a box having an improved removable strip in accordance with a first embodiment of the present invention.

A first embodiment of a blank which is erectable into a box suitable for retaining box contents according to the present invention is generally indicated by reference number 10 in FIG. 1. The blank 10 is preferably formed of any suitable foldable sheet material such as, for example, paperboard. It will be understood that the sheet material may be in the form of a laminate, such as a plastic film (e.g. polypropylene or PET), laminated to the paperboard. Preferably, the plastic film is on the interior of the paperboard blank although it may be provided on the exterior as well.

In FIG. 1, and all other figures showing a plan view of a blank, the surface shown will be that surface forming predominantly the exterior surface of the box into which the blank is erected. Continuous partial cut lines (50% cuts) scored into the exterior surface are indicated by a continuous line with regularly spaced short perpendicular lines crossing the continuous line. Continuous partial cut lines scored into the interior surface are indicated by continuous lines with small regularly spaced X's drawn across the line. Fold channels scored into the foldable material are indicated by a dot-dash line.

As shown in FIG. 1, the blank 10 is suitably cut and/or scored to provide a first side panel 12 and a second side panel 14. Disposed between the first side panel 12 and the second side panel 14 is a first edge panel 16. Disposed on an edge of the second side panel 14 opposed from the first edge panel 16 is a second edge panel 18. The first side panel 12 and the second side panel 14 are each foldable with respect to the first edge panel 16 about a first side panel fold line 22 and a second side panel fold line 24, respectively. The first side panel fold line 22 and the second side panel fold line 24 preferably comprise channels scored into the foldable material. The second edge panel 18 is foldable with respect to the second side panel 14 about a second edge panel fold line 28. The second edge panel fold line 28 preferably comprises a channel scored into the foldable material.

Disposed along the first side panel 12 along an edge opposed the first edge panel 16 is an edge flap 20. The edge flap 20 is foldable with respect to the first side panel 12 about an edge flap fold line 26, which preferably comprises a channel scored into the foldable material.

Disposed on opposing edges of the first side panel 12, perpendicular to the first side panel fold line 22 and the edge flap fold line 26, are first and second seal end flaps 30, 32. The first and second seal end flaps 30, 32 are foldable with respect to the first side panel 12 about first and second seal end flap fold lines 38, 40, respectively. The first and second seal end flap fold lines preferably comprise channels scored into the foldable material.

Disposed on opposing edges of the second side panel 14, perpendicular to the second side panel fold line 24 and the second edge panel fold line 28, are third and fourth seal end flaps 34, 36. The third and fourth seal end flaps 34, 36 are foldable with respect to the second side panel 14 about third and fourth seal end flap fold lines 42, 44, respectively. The third and fourth seal end flap fold lines preferably comprise channels scored into the foldable sheet material.

Disposed on opposing edges of the first edge panel 16, perpendicular to the first side panel fold line 22 and the second side panel fold line 24, are first and second tabs 50, 52. The first and second tabs are foldable with respect to the first edge panel 16 about first and second tab fold lines 58, 60, respectively. The first and second tab fold lines 58, 60 preferably comprise channels scored into the foldable material.

Disposed on opposing edges of the second edge panel, perpendicular to the second edge panel fold line 28, are third and fourth tabs 54, 56. The third and fourth tabs 54, 56 are foldable with respect to the second edge panel 18 about third and fourth tab fold lines 62, 64, respectively. The third and fourth tab fold lines 62, 64 preferably comprise channels scored into the foldable material.

In accordance with the principles of the present invention, one of the seal end flaps is provided with a removable strip portion 70, which can be manually removed from the seal end flap to permit opening of a seal end of the box, to allow access to the container space of the box, as will be described in more detail below.

Each removable strip portion 70 is defined by an interior score pattern and an exterior score pattern. The interior score pattern includes two continuous interior cut lines 80, 82, closely spaced to one another, cut partially into the thickness of the paperboard from the interior surface of the blank. The interior cut lines need not be parallel as shown and could be, for example, opposing arcs. The exterior score pattern is defined by a continuous exterior cut 78 penetrating partially into the thickness of the paperboard from the exterior surface and extending generally along the entire length of the third seal end flap 34. The exterior score pattern is also defined by a line 76 that comprises a plurality of aligned interrupted cuts (short, repeating dashed cuts) penetrating partially into the thickness of the paperboard from the exterior surface. The line 76 of aligned interrupted partial cuts coincides with the seal end flap fold line, corresponding to the seal end flap on which the removable strip portion is disposed, along an extent of the fold line. In the illustrated embodiment, the removable strip portion 70 is disposed on the third seal end flap 34, and line 76 coincides with third seal end flap fold line 42.

Figure 2:
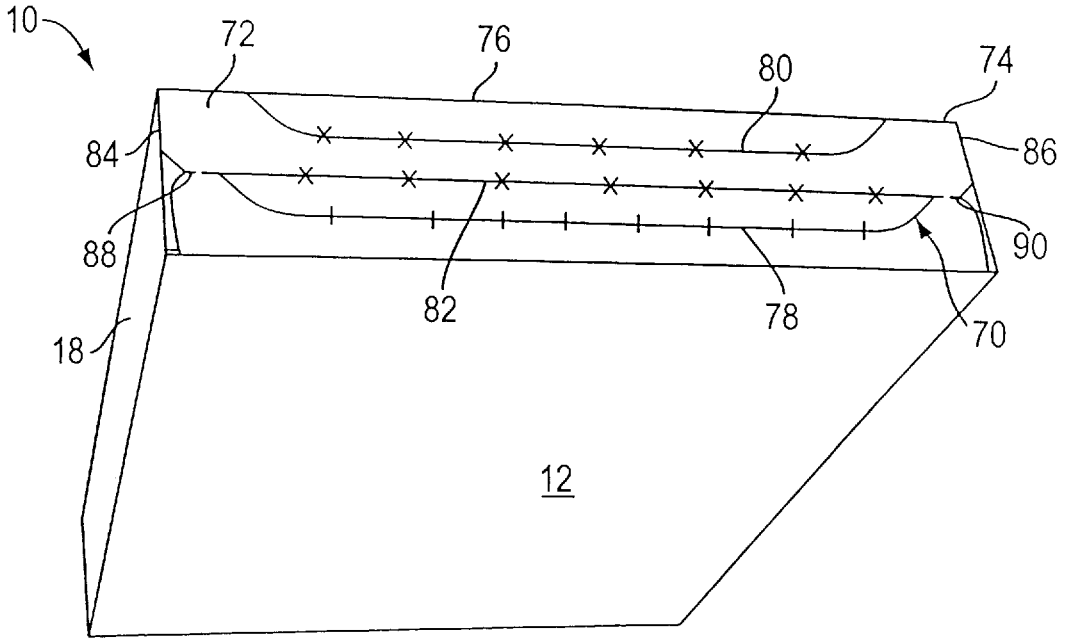
FIG. 2 is an isometric view from above of a box erected from the blank of FIG. 1.

In the embodiment shown in FIGS. 1 and 2, the exterior score pattern of the removable strip portion 70 includes a continuous exterior cut 78 disposed along the length of flap 34 in a spaced relation with respect to the aligned interrupted cuts 76. A possible modification of the improved removable strip of the present invention, not shown, would omit continuous exterior cut 78. With such a modified removable strip portion, flap 34 may be narrower than as shown in FIG. 1 and may, for example, have an outer edge located where exterior cut 78 is shown in FIG. 1.

The removable strip portion 70 also includes grippable portions 72 and 74 for grasping by a user. The grippable portions 72 and 74 are defined on one end thereof by the edge portions 84 and 86, respectively, by extents of third seal end flap fold line 42, and by portions of continuous interior cut line 80 that are not substantially parallel to continuous interior cut line 82. The structure of the grippable portions 72 and 74 further include short line segments 88 and 90, respectively. Short line segments 88 and 90 extend from the outward edge of the third seal end flap 34 and extend to the beginning of the continuous exterior partial cut 78. Short line portions 88 and 90 comprise aligned interrupted 100% through cuts.

In accordance with the principles of the present invention, and as shown in FIG. 2, the blank 10 is erectable into a box having a container space for retaining box contents. In the erected condition of the embodiment shown for illustration purposes in FIG. 2, the first side panel 12 is folded about the first side panel fold line 22 to a position generally perpendicular to the first edge panel 16. The second side panel 14 is folded about the second side panel fold line 24 to a position generally perpendicular to the first edge panel 16 and opposed to the first side panel 12. The edge flap 20 is folded about the edge flap fold line 26 to a position generally perpendicular to the first side panel 12. The second edge panel 18 is folded about the second edge panel fold line 28 to a position generally perpendicular to the second side panel 14 so that it is opposed from the first edge panel 16. The second edge panel 18 is folded in such a manner that a portion thereof overlaps the folded edge flap 20 in planar surface contact therewith and is fixed to the edge flap 20 by a suitable adhesive.

Second tab 52 and fourth tab 56 are folded about the second tab fold line 60 and the fourth tab fold line 64, respectively, inwardly toward each other. Second seal end flap 32 is then folded inwardly about second seal end flap fold line 40 to a position overlapping the inwardly folded second and fourth tabs 52, 56. The fourth seal end flap 36 is folded inwardly about the fourth seal end flap fold line 44 so that it overlaps the inwardly folded second seal end flap 32 in planar surface contact therewith and is fixed to the second seal end flap 32 by means of a suitable adhesive therebetween.

The first and third tabs 50, 54 are each folded inwardly toward each other about first tab fold line 58 and third tab fold line 62, respectively. First seal end flap 30 is folded over first seal end flap fold line 38 so that it overlaps the inwardly folded first and third tabs 50, 54. Third seal end flap 34 is folded inwardly about third seal end flap fold line 42 so that it overlaps the inwardly folded first seal end flap 30 in planar surface contact therewith and is fixed to the first seal end flap 30 by a suitable adhesive.

Preferably, the area of adhesion between third seal end flap 34 and first seal end flap 30 is limited to the area of the third end flap 34 between the continuous interior cut line 82 and the free edge of the third seal end flap 34.

The adhesive utilized may be of any type including either heat activated or pressure activated adhesives. The adhesive may be separately applied to the appropriate portions of the blank prior to or during erection of the blank into a box. Any suitable adhesive may be utilized, it being understood that where the blank material comprises a laminate including a plastic film on the interior surface of the paperboard, portions of the plastic itself may constitute the adhesive which is activated by heat preferably by directing a stream of hot air locally thereto just prior to erecting the blank into a box.

Manual removal of the removable strip portion 70 from the blank will now be described. The grippable portion 72 or 74 may be grasped by first lifting edge portion 84 or 86 away from the blank. Lifting the grippable portion away from the blank will cause the paperboard to delaminate along a delamination surface generally parallel to and between the interior and exterior surfaces of the paperboard. The paperboard will delaminate between continuous interior cut line 82 and the continuous exterior cut line 78 (or, in the case of the alternate embodiment in which exterior cut line 78 is omitted, between interior cut line 82 and the outer edge of flap 34) and between the continuous interior cut line 80 and the exterior cut line 76. As the user continues to pull the grippable portion away from the blank, the removable strip portion will progressively delaminate along a predetermined removal path defined by the interior partial cut lines 80, 82 and the exterior partial cut lines 76, 78.

Figure 4:
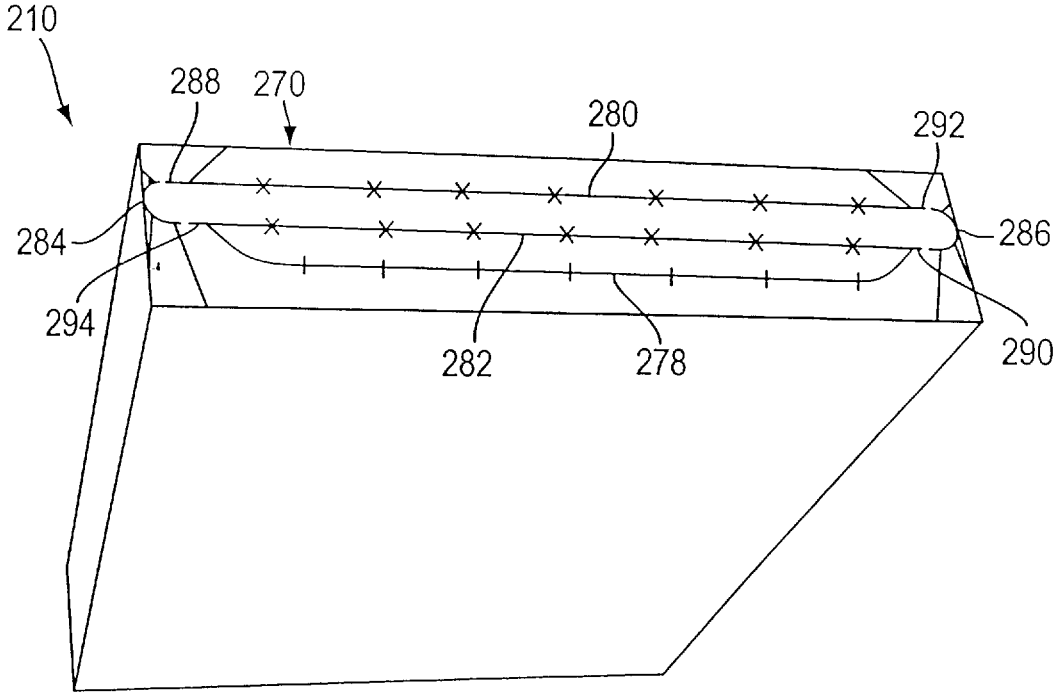
FIG. 4 is an isometric view from above of a box erected from the blank of FIG. 3.
Figure 3:
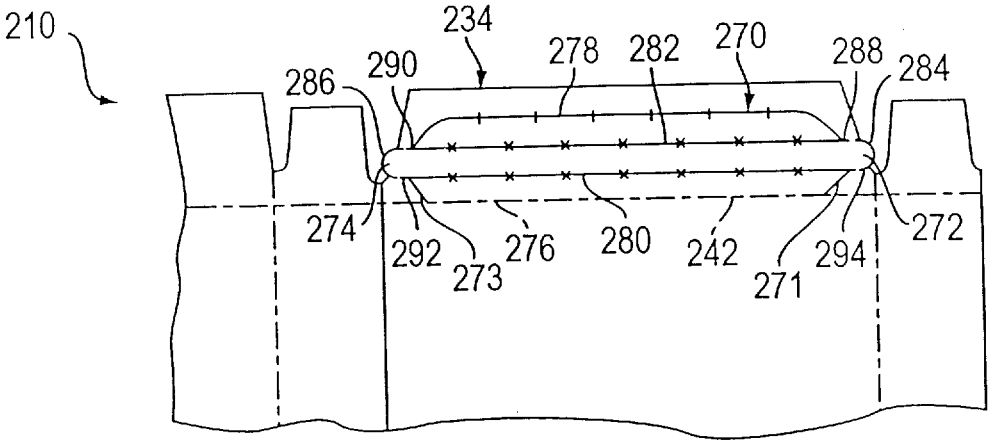
FIG. 3 is a partial plan view of a blank cut and scored so as to be erectable into a box having an improved removable strip in accordance with a second embodiment of the present invention.

A second embodiment of the present invention is indicated generally by reference number 210 in FIGS. 3 and 4. The structure of the second embodiment is in all respects identical to the structure of the first embodiment of FIGS. 1 and 2 except for the shape of the removable strip portion 270 provided on a seal end flap.

The removable strip portion 270 is defined by an interior score pattern and an exterior score pattern. The interior score pattern includes two continuous interior lines 280, 282, closely spaced and generally parallel to one another, cut partially into the thickness of the paperboard from the interior surface of the blank. The exterior score pattern is defined by a continuous exterior cut 278 penetrating partially into the thickness of the paperboard from the exterior surface and extending generally along the entire length of the third seal end flap 234 parallel to the third seal end flap fold line 242 with two segments extending diagonally from the portion parallel to line 242 to continuous interior cut line 278. The exterior score pattern is also defined by a line 276 that comprises a plurality of aligned interrupted cuts (short, repeating dashed cuts) penetrating partially into the thickness of the paperboard from the exterior surface. The line 276 of aligned interrupted partial cuts coincides with the seal end flap fold line, corresponding to the seal end flap on which the removable strip portion is disposed, along an extent of the fold line. In the illustrated embodiment, the removable strip portion 270 is disposed on the third seal end flap 234, and line 276 coincides with third seal end flap fold line 242.

In the embodiment shown in FIGS. 3 and 4, the exterior score pattern of the removable strip portion 270 includes a continuous exterior cut 278 disposed along the length of flap 234 in a spaced relation with respect to the aligned interrupted cuts 276. A possible modification of the improved removable strip of the present invention, not shown, would omit continuous exterior cut 278. With such a modified removable strip portion, flap 234 may be narrower than as shown in FIG. 3 and may, for example, have an outer edge located where exterior cut 278 is shown in FIG. 3.

The removable strip portion 270 is provided with grippable portions 272 and 274 which are extensions of the strip defined by interior cut lines 280 and 282. The grippable portions 272 and 274 are defined by edge portions 284 and 286, respectively. Grippable portion 272 is further defined by short line segments 288 and 294 which comprise aligned interrupted 100% through cuts extending from the edge portion 284 to the beginning of the exterior lines 278 and 271. Grippable portion 286 is further defined by short line segments 290 and 292 which comprise aligned interrupted 100% through cuts extending from edge portion 286 to continuous exterior lines 278 and 273, respectively.

The exterior score pattern further includes lines 271 and 273, which comprise short continuous lines cut partially into the paperboard from the exterior surface. Line 271 extends diagonally from continuous interior cut line 280, at a point proximate grippable portion 272, to line 276. Line 273 extends diagonally from continuous interior cut line 280, at a point proximate grippable portion 274, to line 276.

As with the embodiment of FIGS. 1 and 2, the removable strip portion of the second embodiment is removed by grasping a grippable end, 272 or 274, thereof at the edge portion 284 or 286 and lifting the same away from the seal end flap of the box. By continuously lifting the removable strip portion 270 away from the seal end flap, the paperboard will delaminate between continuous interior cut line 282 and continuous exterior cut line 278 (or, in the case of the alternate embodiment in which exterior cut line 278 is omitted, between interior cut line 282 and the outer edge of flap 234) and between continuous interior cut line 280 and exterior cut lines 271, 276, and 273.

Figure 5:
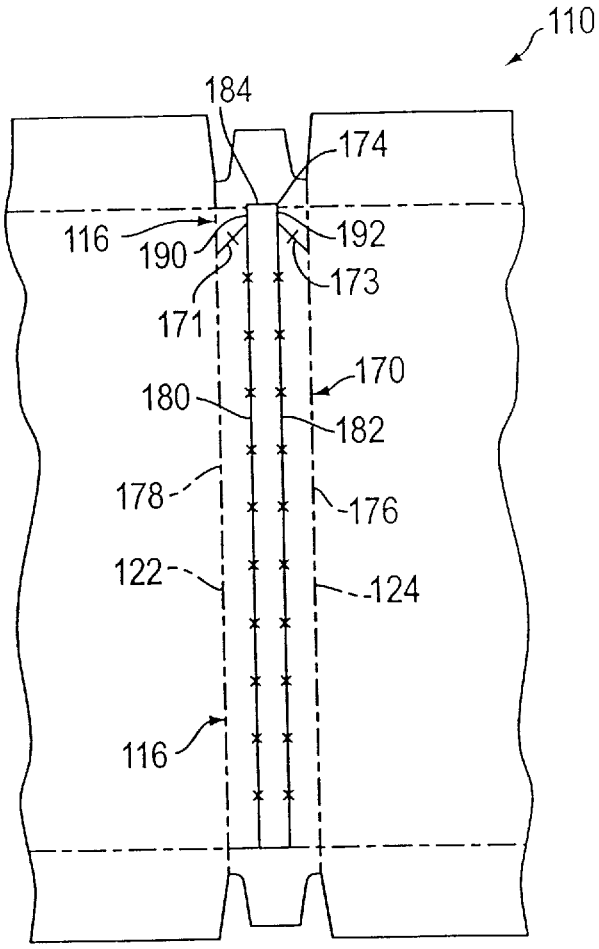
FIG. 5 is a partial plan view of a blank cut and scored so as to be erectable into a box having an improved removable strip in accordance with a third embodiment of the present invention.
Figure 6:
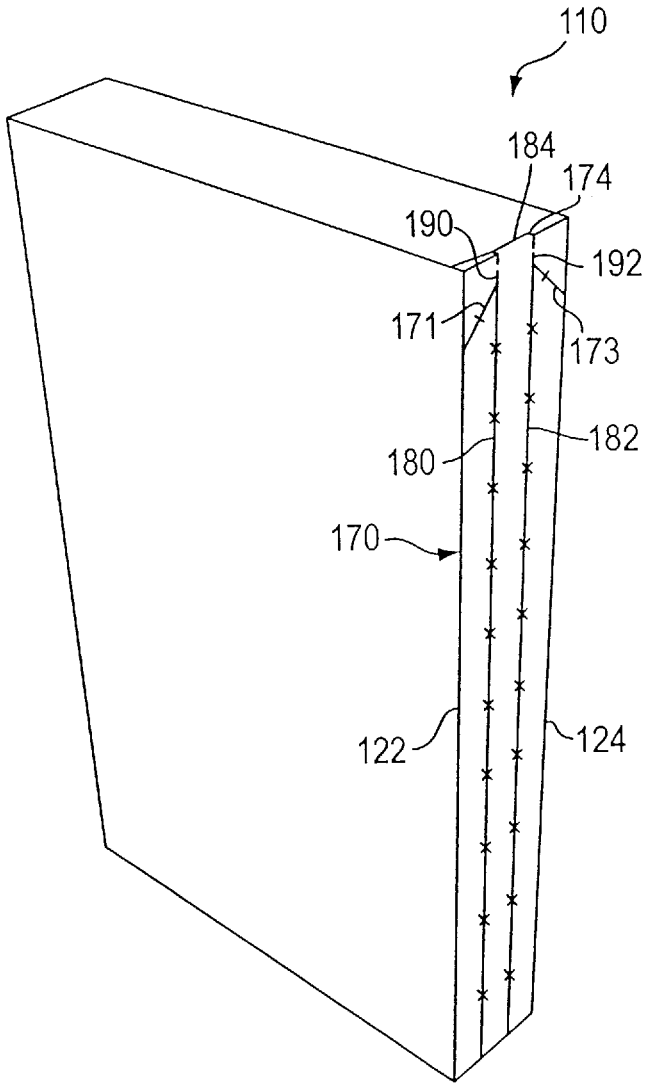
FIG. 6 is an isometric view of a box erected from the blank of FIG. 5.

A third embodiment of the present invention is indicated generally by reference number 110 in FIGS. 5 and 6. The third embodiment 110 is in all respects identical to the first and second embodiments of FIGS. 1–4, except in the position of the removable strip portion 170. In the third embodiment of the present invention, the removable strip portion 170 is provided on the first edge panel 116. As with the above described embodiments, the removable strip portion 170 is defined by an interior score pattern and an exterior score pattern. The interior score pattern includes two continuous interior cut lines 180, 182, closely spaced and generally parallel to one another, cut partially into the thickness of the paperboard from the interior surface of the blank.

A grippable portion 174 is provided. The grippable portion 174 is an extension of the strip defined by the continuous interior cut lines 180, 182. The grippable portion 174 has a first edge portion 184 and two short lined segments 190, 192. The short line segments 190, 192 comprise aligned interrupted 100%. through cuts extending from edge portion 184 to lines 171 and 173.

The exterior score pattern is defined by lines 171 and 173 which comprise continuous exterior cut lines cut partially into the thickness of the paperboard and extending from the exterior surface of the blank and extending diagonally from lines 180 and 182, respectively, proximate grippable portion 174 to first and second side panel fold lines 122, 124, respectively. The exterior score pattern further comprises lines 176 and 178 which each comprise a plurality of aligned interrupted cuts penetrating partially into the thickness of the paperboard from the exterior surface. The lines 176 and 178 of the aligned interrupted partial cuts coincide with the second and first side panel fold lines 124, 122, respectively.

The removable strip portion 170 is removed from the box 110 by lifting the edge 184 away from the first edge panel 116 and grasping the grippable portion 174 to pull the removable strip portion 170 away from the box. By continuously pulling the removable strip portion 170 away from the box, the paperboard will delaminate between continuous interior cut line 180 and exterior line 176 and between continuous interior cut line 182 and line 178.

The improved removable strip of the present invention has been illustrated in the figures and generally described in this specification in terms of a rectangular box having sides and panels that are perpendicular to adjoining sides and panels. It is to be understood, however, that the improved removable strip of the present invention may be used in conjunction with non-rectangular boxes and could be used with a variety of geometrical shapes.

The improved removable strip of the present invention may also be used in conjunction with boxes having extensions to the sealing flap, such as a "seal tuck" carton, or have sealing flaps that are abbreviated and are not the same length of the opening, but overlap enough to seal.

Having described the invention, it will be apparent to those skilled in the art that various modifications may be made thereto without departing from the spirit and scope of this invention as defined in the appended claims.

What is claimed is:

1. A rectangular box, having six walls and defining a container space, composed of a foldable sheet material having exterior and interior surfaces defining a thickness therebetween, said box comprising:

first and second side panels disposed in opposed spaced relation with respect to each other, the planar dimensions of each of said first and second side panels defining the height and width of said box;

first and second edge panels disposed in opposed spaced relation with respect to each other, said first edge panel being integral along first edge fold lines with said first and said second side panels, and said second edge panel being integral along a second edge fold line with said second side panel, the planar dimensions of said first edge panel defining the height and depth of said box; and first, second, third, and fourth end flaps, said first and second end flaps being disposed with respect to each other along opposite ends of said first side panel with which said first and second end flaps are integral along associated first and second end flap fold lines, respectively, and said third and fourth end flaps being disposed with respect to each other along opposite ends of said second side panel with which said third and fourth end flaps are integral along associated third and fourth end flap fold lines, respectively, the six walls of said rectangular box defining the container space including side walls comprising said first and second side panels, edge walls comprising said first and second edge panels, and end walls comprising said first and third end flaps folded in overlapping relation about said associated first and third end flap fold lines, respectively, and said second and fourth end flaps folded in overlapping relation about said associated second and fourth end flap fold lines, respectively, the planar dimensions of said end walls defining the width and depth of said box, wherein the depth of said box is less than either the height or the width of said box, said box providing a removable strip portion disposed on an access panel, said access panel comprising a top flap of said first and third end flaps folded in overlapping relation or said second and fourth end flaps folded in overlapping relation, said removable strip portion extending along the long dimension of said access panel and being constructed and arranged to be completely removed from said access panel to permit the end flap with which said access panel is folded in overlapping relation to be unfolded to a position permitting access to said container space, said removable strip portion being defined on an exterior surface thereof by exterior score patterns, and on an interior surface thereof by interior score patterns, said removable strip portion being constructed and arranged to be removed by manually grasping a grippable portion thereof and pulling said removable strip portion away from said access panel to progressively delaminate said sheet material between said interior and exterior score patterns along a predetermined removal path including an extent adjacent an associated fold line of said access panel, said interior score pattern including continuous interior cut lines partially penetrating said thickness from said interior surface and disposed for at least an extent thereof in a closely spaced generally parallel arrangement, said interior score pattern extending along said predetermined removal path to ensure that delamination occurs along said predetermined removal path, said exterior score pattern including exterior cuts partially penetrating said thickness from said exterior surface and extending along said predetermined removal path to ensure that delamination occurs along said predetermined removal path, said exterior cuts including a plurality of aligned interrupted cuts disposed along at least a portion of said associated fold line of said access panel to ensure that the integrity of the exterior surface at said associated fold line of said access panel is retained and to ensure that said access panel is folded about said associated fold line.

2. The box of claim 1 wherein said exterior cuts further include a continuous exterior cut disposed on said access panel in a spaced relation with respect to said aligned interrupted cuts.

3. The box of claim 1, further comprising first, second, third, and fourth end tabs, said first and second end tabs being disposed with respect to each other along opposite ends of said first edge panel with which said first and second end tabs are integral along associated first and second end tab fold lines, respectively, and said third and fourth end tabs being disposed with respect to each other along opposite ends of said second edge panel with which said third and fourth end tabs are integral along associated third and fourth end tab fold lines, respectively, wherein said first and third end flaps overlap said first and third end tabs folded about said associated first and third end tab fold lines, respectively, and said second and fourth end flaps overlap said second and fourth end tabs folded about said associated second and fourth end tab fold lines, respectively.

4. The box of claim 1 wherein said grippable portion is defined by an extension of a strip defined by said continuous interior cut lines and is defined by a free edge portion and two line segments comprising aligned interrupted 100% through cuts, each said line segment extending from said free edge to one of said continuous interior cut lines.

5. A blank of foldable sheet material having exterior and interior surfaces defining a thickness therebetween, said blank being erectable into a rectangular box having six walls enclosing a container space suitable for retaining box contents therein, said blank comprising:

first and second side panels, the planar dimensions of each of said first and second side panels defining the height and width of the box erected from said blank;

first and second edge panels, said first edge panel being integral along first edge fold lines with said first and said second side panels, and second edge panel being integral along a second edge fold line with said second side panel, the planar dimensions of said first edge panel defining the height and depth of the box erected from said blank; and first, second, third, and fourth end flaps, said first and second end flaps being disposed with respect to each other along opposite ends of said first side panel with which said first and second end flaps are integral along associated first and second end flap fold lines, respectively, and said third and fourth end flaps being disposed with respect to each other along opposite ends of said second side panel with which said third and fourth end flaps are integral along associated third and fourth end flap fold lines, respectively, the six walls of the rectangular box erected from said blank which define the container space including side walls comprising said first and second side panels, edge walls comprising said first and second edge panels, and end walls comprising said first and third end flaps folded in overlapping relation about said associated first and third end flap fold lines, respectively, and said second and fourth end flaps folded in overlapping relation about said associated second and fourth end flap fold lines, respectively, the planar dimensions of said end walls defining the width and depth of the box erected from said blank, wherein the depth of said box is less than either the height or the width of said box, said box providing a removable strip portion disposed on an access panel, said access panel comprising a top flap of said first and third end flaps which are to be folded in overlapping relation when said blank is erected or a top flap of said second and fourth end flaps which are to be folded in overlapping relation when said blank is erected, said removable strip portion extending along the long dimension of said access panel and being constructed and arranged to be completely removed from said access panel to permit the end flap with which said access panel is folded in overlapping relation when said blank is erected to be unfolded to a position permitting access to the container space, said removable strip portion being defined on an exterior surface thereof by exterior score patterns, and on an interior surface thereof by interior score patterns, said removable strip portion being constructed and arranged to be removed by manually grasping a grippable portion thereof and pulling said removable strip portion away from said access panel to progressively delaminate said sheet material between said interior and exterior score patterns along a predetermined removal path including an extent adjacent an associated fold line of said access panel, said interior score pattern including continuous interior cut lines partially penetrating said thickness from said interior surface and disposed for at least an extent thereof in a closely spaced generally parallel arrangement, said interior score pattern extending along said predetermined removal path to ensure that delamination occurs along said predetermined removal path, said exterior score pattern including exterior cuts partially penetrating said thickness from said exterior surface and extending along said predetermined removal path to ensure that delamination occurs along said predetermined removal path, said exterior cuts including a plurality of aligned interrupted cuts disposed along at least a portion of said associated fold line of said access panel to ensure that the integrity of the exterior surface at said associated fold line of said access panel is retained when said blank is erected and to ensure that said access panel is folded about said associated fold line when said blank is erected.

* * * * *